US011060377B1

(12) United States Patent
Alghamdi et al.

(10) Patent No.: US 11,060,377 B1
(45) Date of Patent: Jul. 13, 2021

(54) COMPLETING A WELLBORE

(71) Applicant: Saudi Arabian Oil Company, Dhahran (SA)

(72) Inventors: Magid A. Alghamdi, Dhahran (SA); Rami G. Alhazmi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/820,226

(22) Filed: Mar. 16, 2020

(51) Int. Cl.
*E21B 34/14* (2006.01)
*E21B 33/12* (2006.01)
*E21B 43/26* (2006.01)

(52) U.S. Cl.
CPC ..... *E21B 34/14* (2013.01); *E21B 33/12* (2013.01); *E21B 43/26* (2013.01); *E21B 2200/04* (2020.05)

(58) Field of Classification Search
CPC ..... E21B 34/14; E21B 43/26; E21B 33/12; E21B 2200/04; E21B 43/2605; E21B 43/2607; E21B 43/27; E21B 34/142; E21B 33/00
See application file for complete search history.

(56) References Cited

U.S. PATENT DOCUMENTS

| | | | | |
|---|---|---|---|---|
| 6,464,006 | B2 | 10/2002 | Womble | |
| 2001/0015275 | A1 | 8/2001 | Petegem et al. | |
| 2010/0175894 | A1* | 7/2010 | Debard | E21B 34/10 166/382 |
| 2012/0199346 | A1* | 8/2012 | Patel | E21B 43/08 166/278 |

* cited by examiner

*Primary Examiner* — James G Sayre
(74) *Attorney, Agent, or Firm* — Fish & Richardson P.C.

(57) ABSTRACT

A method for disposing a completion assembly within a wellbore in a single trip. The completion assembly includes a mechanical formation isolation valve in an open position, a production sealing element, and a production sealing element setting tool. An acid wash is performed using the completion assembly within the wellbore. After performing the acid wash, the production sealing element is activated with the production sealing element setting tool, fluidically sealing a wellbore upper section uphole of the completion assembly from a wellbore lower section downhole of the completion assembly. The production sealing element setting tool is decoupled from the production sealing element. The mechanical formation isolation valve is maintained in the open position. The production sealing element setting tool is pulled out of the wellbore.

18 Claims, 8 Drawing Sheets

COMPLETING A WELLBORE

TECHNICAL FIELD

This disclosure relates to completing a wellbore.

BACKGROUND OF THE DISCLOSURE

A completion is the equipment placed in a wellbore after the wellbore has been drilled in the Earth by a drilling rig. The completion is used to extract naturally occurring oil and gas deposits from the Earth and move the oil and gas to the surface of the Earth. Completion equipment may be placed in an open wellbore or in a cased wellbore. An open wellbore is a wellbore that is in direct contact with the Earth and various sub-surface formations of the Earth. A cased wellbore is a wellbore that has been sealed from the Earth and various sub-surface formations of the Earth. A wellbore can be fully cased or have portions that are open. Completing a wellbore is the process of disposing or placing the completion equipment within the wellbore.

SUMMARY

This disclosure describes technologies related to completing a wellbore in a single trip.

Implementations of the present disclosure include a method for completing a wellbore in a single trip. A completion assembly is disposed within a wellbore in a single trip. The completion assembly includes a mechanical formation isolation valve in an open position, a production sealing element, and a production sealing element setting tool. An acid wash is performed using the completion assembly within the wellbore. After performing the acid wash, the production sealing element is activated with the production sealing element setting tool fluidically sealing a wellbore upper section uphole of the completion assembly from a wellbore lower section downhole of the completion assembly. The production sealing element setting tool is decoupled from the production sealing element. The mechanical formation isolation valve is maintained in the open position. The production sealing element setting tool is pulled out of the wellbore.

In some implementations, where the completion assembly is a first completion assembly, completing the wellbore in a single trip further includes, after pulling the production sealing element tool out of the wellbore, disposing a second completion assembly including a shifting key tool to shift the mechanical formation isolation valve between the open position and a closed position within the wellbore. The second completion assembly is stung into the first completion assembly. The mechanical formation isolation valve is shifted from the open position to the closed position using the shifting key tool.

In some implementations, shifting the mechanical formation isolation valve from the open position to the closed position using an anchor and a linear actuator shifting key tool further includes coupling the shifting key tool contained in the second completion assembly to the mechanical formation isolation valve. The shifting key tool is anchored to the wellbore. The linear actuator is configured to mate with the mechanical formation isolation valve and mated to the mechanical formation isolation valve. The mechanical formation isolation valve is shifted with the linear actuator. The linear actuator is de-mated from the mechanical formation isolation valve. The shifting key tool is disengaged from the wellbore. The shifting key tool contained in the second completion assembly is decoupled from the mechanical formation isolation valve.

In some implementations, shifting using a circular profile shifting key tool further includes shifting the mechanical formation isolation valve from the open position to the closed position by coupling the shifting key tool contained in the second completion assembly to the mechanical formation isolation valve. The circular profile key shifting key tool is anchored to the wellbore. The linear actuator is extended to mate with the mechanical formation isolation valve. The circular profile shifting key tool is extended to latch the mechanical formation isolation valve. The mechanical formation isolation valve is shifted with the linear actuator and circular profile key. The circular profile key is contracted to de-latch the mechanical formation isolation valve. The linear actuator is de-mated from the mechanical formation isolation valve. The shifting key tool is disengaged from the wellbore. The shifting key tool contained in the second completion assembly is decoupled from the mechanical formation isolation valve.

In some implementations, disposing the completion assembly within the wellbore in the single trip further includes coupling the completion assembly to a production string outside the wellbore. The completion assembly is disposed within the wellbore with the production string. The production sealing element setting tool is pulled out of the wellbore via the production string.

In some implementations, where the completion assembly includes a screened inflow control device and a swell packer, completing the wellbore in a single trip further includes disposing the screened inflow control device and the swell packer within the wellbore in the single trip.

In some implementations, where the completion assembly further includes a wash pipe, completing the wellbore in a single trip further includes disposing the wash pipe within the wellbore in the single trip. The wash pipe is pulled out of the wellbore when pulling the production sealing element setting tool out of the wellbore.

Further implementations of the present disclosure include a method for completing a wellbore in a single trip where the completion assembly includes a screened multi-tasking valve inflow control device, a mechanical formation isolation valve in an open position, a production sealing element, and a production sealing element setting tool. The completion including a screened multi-tasking valve inflow control device, a mechanical formation isolation valve in an open position, a production sealing element, and a production sealing element setting tool is disposed within a wellbore on a single trip. An acid wash is performed using the completion assembly within the wellbore. After performing the acid wash, the production sealing element is activated with the production sealing element setting tool, fluidically sealing a wellbore upper section uphole of the completion assembly from a wellbore lower section downhole of the completion assembly. The production sealing element setting tool is decoupled from the production sealing element. The mechanical formation isolation valve is maintained in the open position. The production sealing element setting tool is pulled out of the wellbore.

In some implementations, where the completion assembly is a first completion assembly, after pulling the production sealing element tool out of the wellbore, completing the wellbore in a single trip further includes disposing a second completion assembly within the wellbore including a shifting key tool to shift the mechanical formation isolation valve between the open position and a closed position. The second completion assembly is stung into the first completion assembly. The mechanical formation isolation valve is shifted from the open position to the closed position shifting using the shifting key tool.

In some implementations, shifting, where the shifting key tool further includes an anchor and a linear actuator, the mechanical formation isolation valve from the open position to the closed position further includes coupling the shifting key tool contained in the second completion assembly to the mechanical formation isolation valve. The shifting key tool is anchored to the wellbore. The linear actuator is extending to mate with the mechanical formation isolation valve. The shifting key tool is mated to the mechanical formation isolation valve. The mechanical formation isolation valve is shifted with the linear actuator. The linear actuator is de-mated from the mechanical formation isolation valve. The shifting key tool is disengaged from the wellbore. The shifting key tool contained in the second completion assembly is decoupled from the mechanical formation isolation valve.

In some implementations, where shifting, using the shifting key tool further including a circular profile key, the mechanical formation isolation valve from the open position to the closed position further includes coupling the shifting key tool contained in the second completion assembly to the mechanical formation isolation valve. The shifting key tool anchoring to the wellbore. The linear actuator configured to mate with the mechanical formation isolation valve is extended. The shifting key tool is mated to the mechanical formation isolation valve. The circular profile key is extended to latch the mechanical formation isolation valve. The mechanical formation isolation valve is shifting with the linear actuator and circular profile key. The circular profile key contracting to de-latch the mechanical formation isolation valve. The linear actuator is de-mated from the mechanical formation isolation valve. The shifting key tool disengaging from the wellbore. The shifting key tool contained in the second completion assembly is decoupled from the mechanical formation isolation valve.

In some implementations, disposing the completion assembly within the wellbore in the single trip further includes coupling the completion assembly to a production string outside the wellbore. The completion assembly is disposed in the wellbore with the production string. The production sealing element setting tool is pulled out of the wellbore via the production string. The mechanical formation isolation valve is actuated to a closed position with the mechanical formation isolation valve shifting tool.

Further implementations of the present disclosure include a method for completing a wellbore in a single trip further including disposing a first completion assembly within a wellbore in a single trip including a mechanical formation isolation valve in an open position. An acid wash is performed using the first completion assembly within the wellbore. After performing the acid wash, the wellbore upper section uphole of the first completion assembly is fluidically sealed by the first completion assembly from a wellbore lower section downhole of the first completion assembly. A second completion assembly is disposed within the wellbore after disposing the first completion assembly within the wellbore. The second completion assembly includes a shifting key tool to shift the mechanical formation isolation valve from the open position to a closed position. The mechanical formation isolation valve is shifted to the closed position by actuating the shifting key tool.

In some implementations, completing the wellbore in a single trip further includes coupling a first completion assembly to a production string outside a wellbore, the first completion assembly comprising a screened inflow control device, a swell packer, a mechanical formation isolation valve in an open position, a production sealing element, and a production sealing element setting tool.

In some implementations, where fluidically sealing, by the first completion assembly, a wellbore upper section uphole of the first completion assembly from a wellbore lower section downhole of the first completion assembly further includes activating the production sealing element with the production sealing element setting tool, where activating the production sealing element causes a production sealing element outer surface to mechanically engage the wellbore.

In some implementations, after fluidically sealing the wellbore, decoupling the production sealing element setting tool from the production sealing element further includes maintaining the mechanical formation isolation valve in the open position. The production sealing element setting tool and the production string is pulled out of the wellbore.

In some implementations, completing the wellbore in a single trip further includes assembling a second completion assembly outside the wellbore where the second completion assembly includes a production tubing, an electric submersible pump packer, and an electric submersible pump. The second completion assembly is disposed within the wellbore. The second completion assembly is coupled to the first completion assembly. The mechanical formation isolation valve is actuated to the open position.

In some implementations, performing the acid wash further includes attaching a wash pipe to the first completion assembly. The first completion assembly disposed within a wellbore in a single trip. An acid wash is performed using the completion assembly within the wellbore. The wash pipe, the production sealing element setting tool, and the production string are pulled out of the wellbore.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION OF THE DISCLOSURE

The present disclosure relates to completing a lower section of a wellbore in a single trip. Completing the lower section of the wellbore includes disposing a lower completion assembly within a wellbore in a single trip. A trip is the process of moving a tool or assembly from the surface of the Earth, placing the tool or assembly in the wellbore, moving the tool or assembly to a specified location down the wellbore, performing prescribed operations with the tool or the assembly, and removing the tool and assembly, or a portion of the assembly, from the wellbore. The completion assembly utilized to complete the lower wellbore in a single trip includes a mechanical formation isolation valve in an open position, a production sealing element, and a production sealing element setting tool. With the lower completion assembly placed in the wellbore, an acid wash is performed using the completion assembly within the wellbore. After performing the acid wash, the production sealing element is activated with the production sealing element setting tool. The activated production sealing element fluidically seals a wellbore upper section uphole of the lower completion assembly from a wellbore lower section downhole of the lower completion assembly. With the upper section uphole of the lower completion assembly fluidically sealed from the wellbore lower section downhole of the lower completion assembly, the production sealing element setting tool is decoupled from the production sealing element. The mechanical formation isolation valve is maintained in the open position. With the lower completion assembly in place and fluidically sealed, the production sealing element setting tool is pulled out of the wellbore.

Implementations of the present disclosure realize one or more of the following advantages. The lower completion is performed in one trip instead of in two trips. Consequently, time required to accomplish the objective of placing the lower completion is significantly reduced. Also, worker safety is improved by combining portions of the lower completions to perform the same function so fewer connections and movement between heavy components are necessary. Decreased time that the well is not fully completed also decreases time for potential adverse environmental impacts if an accident or well control event occurs. In this manner, reduced overall well cost can be achieved. Reduced cost can be achieved by utilizing fewer completion components. Also, fewer man-hours are required to assemble one completion assembly as opposed to two completion assemblies. One large cost for drilling and completing a wellbore is the rig and personnel cost. Reducing the number of trips required to complete a lower section of the well reduces the overall cost of the well and increases profitability. Also, completion operations are optimized to achieve the same end goal with fewer technical operations and steps.

Figure 1:
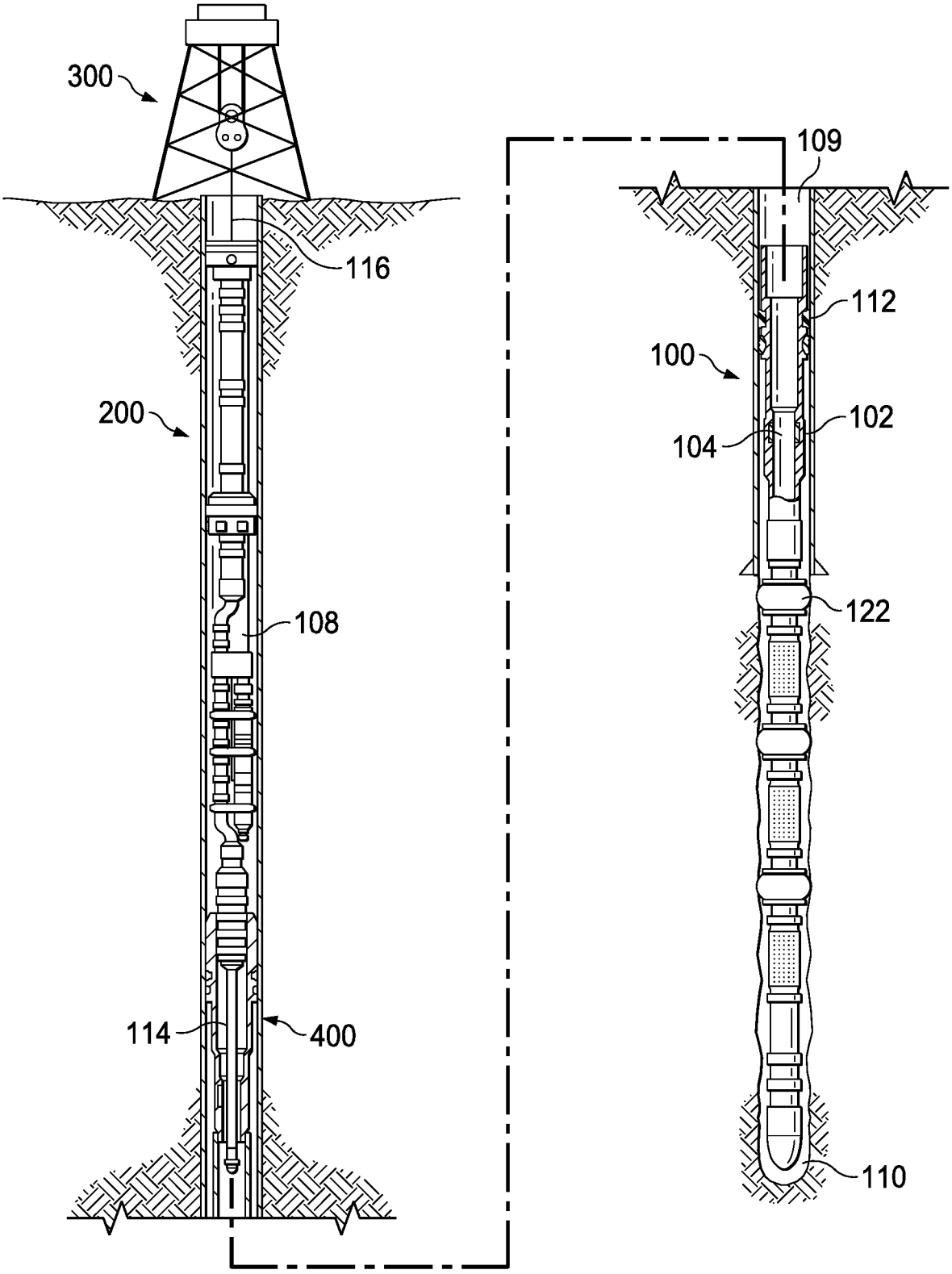
FIG. 1 is a schematic view of a lower and upper completion assembly integrated into a well completing system.

Referring to FIG. 1, a lower completion assembly 100 for completing a wellbore 400 in a single trip is shown. The lower completion assembly 100 is disposed within the wellbore 400 by the drilling rig 300. The drilling rig 300 can be a land-based or a sea-based drilling rig. The lower completion assembly 100 includes a mechanical formation isolation valve 102 in an open position 104, a production sealing element 112, and a production sealing element setting tool 114.

Figure 5A:
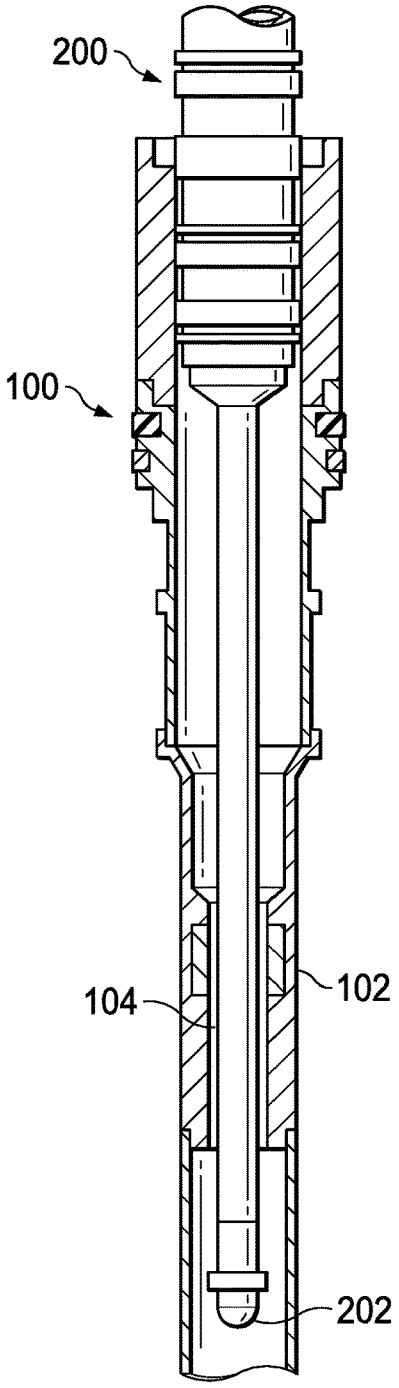
FIG. 5A is a schematic view of the mechanical formation isolation valve of FIG. 1 in the open position.
Figure 5B:
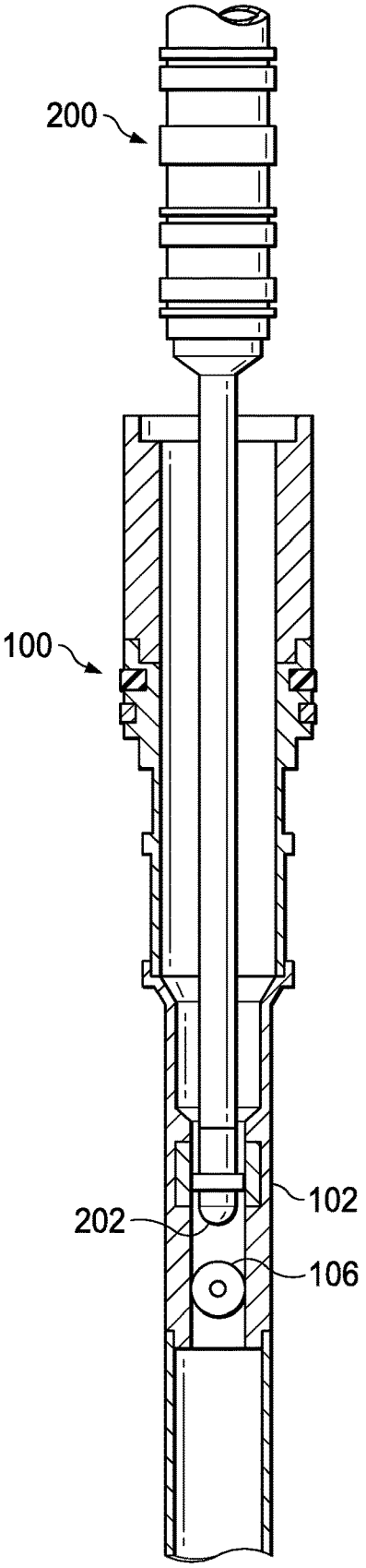
FIG. 5B is a schematic view of the mechanical formation isolation valve of FIG. 1 actuated by the shifting key tool causing the mechanical formation isolation valve to be in the closed position.

The mechanical formation isolation valve 102 has two positons: open position 104 and closed position 106 (shown in FIG. 5B). When the mechanical formation isolation valve 102 is in the open position 104, drilling fluid 108 from the wellbore 400 travels from the drilling rig 300, down the interior 109 of the lower completion assembly 100, out the bottom hole end 110 of the lower completion assembly 100. In some implementations, the mechanical formation isolation valve is a ball valve. The ball valve contains a ball with an internal channel. The ball rotates to allow the internal channel to align with an axis corresponding to the central axis of the tube it is in line with, allowing fluid to flow. In some instances, the ball is rotated, shifting the channel out of the flow path, thus sealing the tube and isolating fluid flow.

The production sealing element 112 can be a mechanical packer. The production sealing element 112 is placed in the wellbore 400 at a location above the desired oil and gas producing region to fluidically seal a wellbore upper section uphole of the completion assembly from a wellbore lower section downhole of the lower completion assembly. In some implementations, multiple production sealing elements 112 are used to isolate multiple oil and gas producing zones from non-producing zones in the wellbore 400.

The production sealing element 112 is, in some instances, mechanically coupled to the production sealing element setting tool 114. The production sealing element setting tool 114 actuates the production sealing element to mechanically engage in wellbore 400, thus fluidically sealing a wellbore upper section uphole of the completion assembly from a wellbore lower section downhole of the lower completion assembly 100. The production sealing element setting tool 114 is coupled to tubing 116 (shown in FIG. 2) extending to the surface of the Earth and the drilling rig 300. Once the production sealing element 112 is engaged in the wellbore 400, the production sealing element setting tool 114 disconnects from the production sealing element 112 and is retrieved to the surface of the Earth by the tubing 116.

Figure 2A:
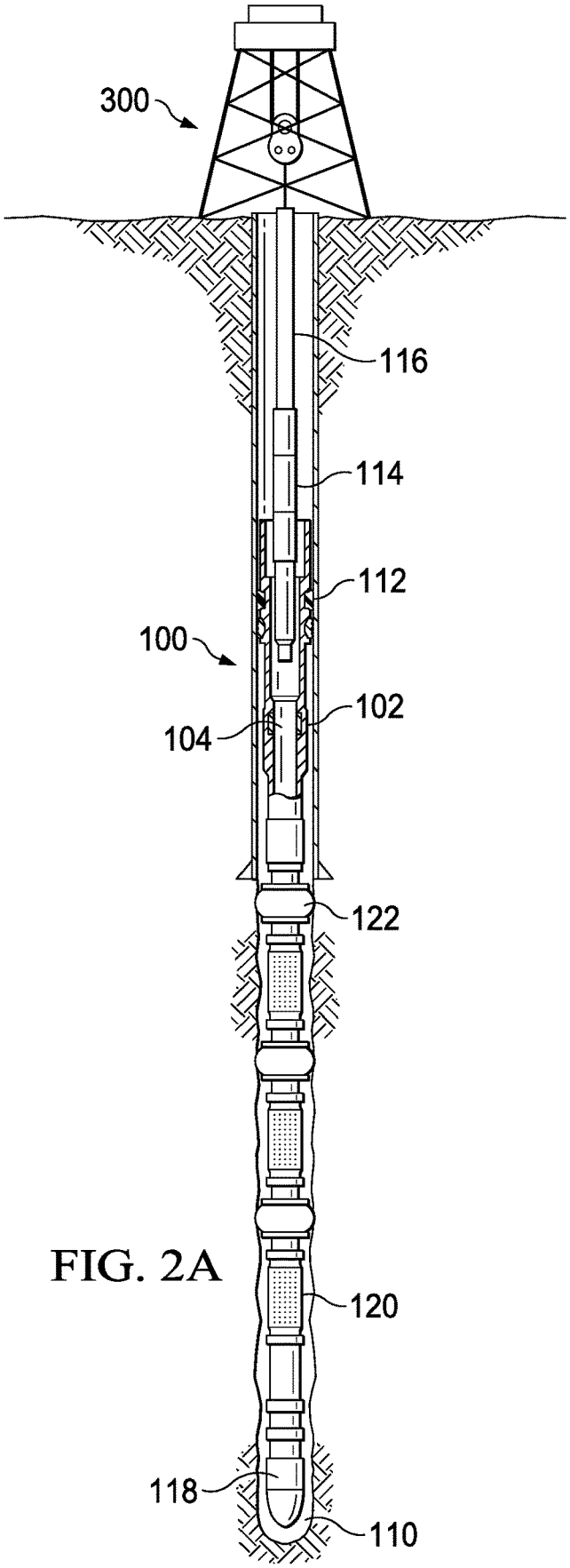
FIG. 2A is a schematic view of the lower completion assembly of FIG. 1 disposed within the wellbore connected to the drilling rig.
Figure 2B:
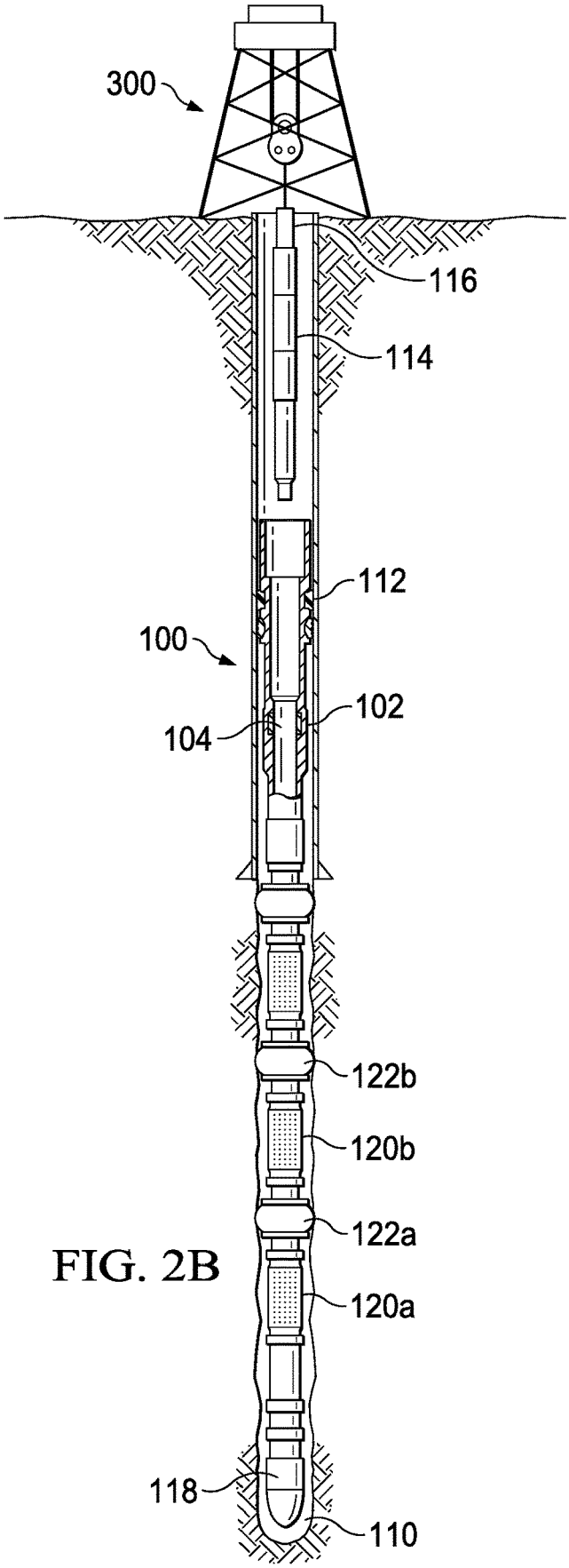
FIG. 2B is a schematic view of the lower completion assembly of FIG. 1 disposed within the wellbore with the production sealing element mechanically engaged in wellbore.

FIGS. 2A and 2B show schematic views of the lower completion assembly 100. FIG. 2A is a schematic view of the lower completion assembly 100 disposed within the wellbore 400 connected to the drilling rig 300 via the tubing 116 and production sealing element setting tool 114. FIG. 2B is a schematic view of the lower completion assembly 100 disposed within the wellbore 400 with the production sealing element 112 mechanically engaged in wellbore 400, fluidically sealing the wellbore upper section uphole of the lower completion assembly 100 from the wellbore lower section downhole of the lower completion assembly 100. The production sealing element setting tool 114 is disconnected from the production sealing element 112 and ready to be tripped out of the wellbore 400 by the drilling rig 300 via the tubing 116. In some implementations, the lower completion assembly 100 includes a shoe 118 as the bottom component. The shoe 118 is in direct contact with the bottom hole 110 of the wellbore 400. Shoe 118 can be a casing shoe, a guide shoe, or a float shoe. In some implementations, the lower completion assembly 100 includes a screened inflow control device 120 positioned below the mechanical isolation valve 102 and above the shoe 118. Multiple screened inflow control devices 120 can be included in the lower completion assembly 100. The screened inflow control device 120 filters large particulate matter that can damage completion tools such as sand. Screened inflow control device 120 regulate and equalize oil and gas ingress flow rate along the lower completion assembly 100. In some implementations, the lower completion assembly 100 includes swell packers 122. Swell packers 122 are positioned below the mechanical formation isolation valve 102, and in between screened inflow control devices 120. Swell packers 122 can expand in the presence of either hydrocarbons or water and are used to isolate sections of the wellbore.

Figure 3:
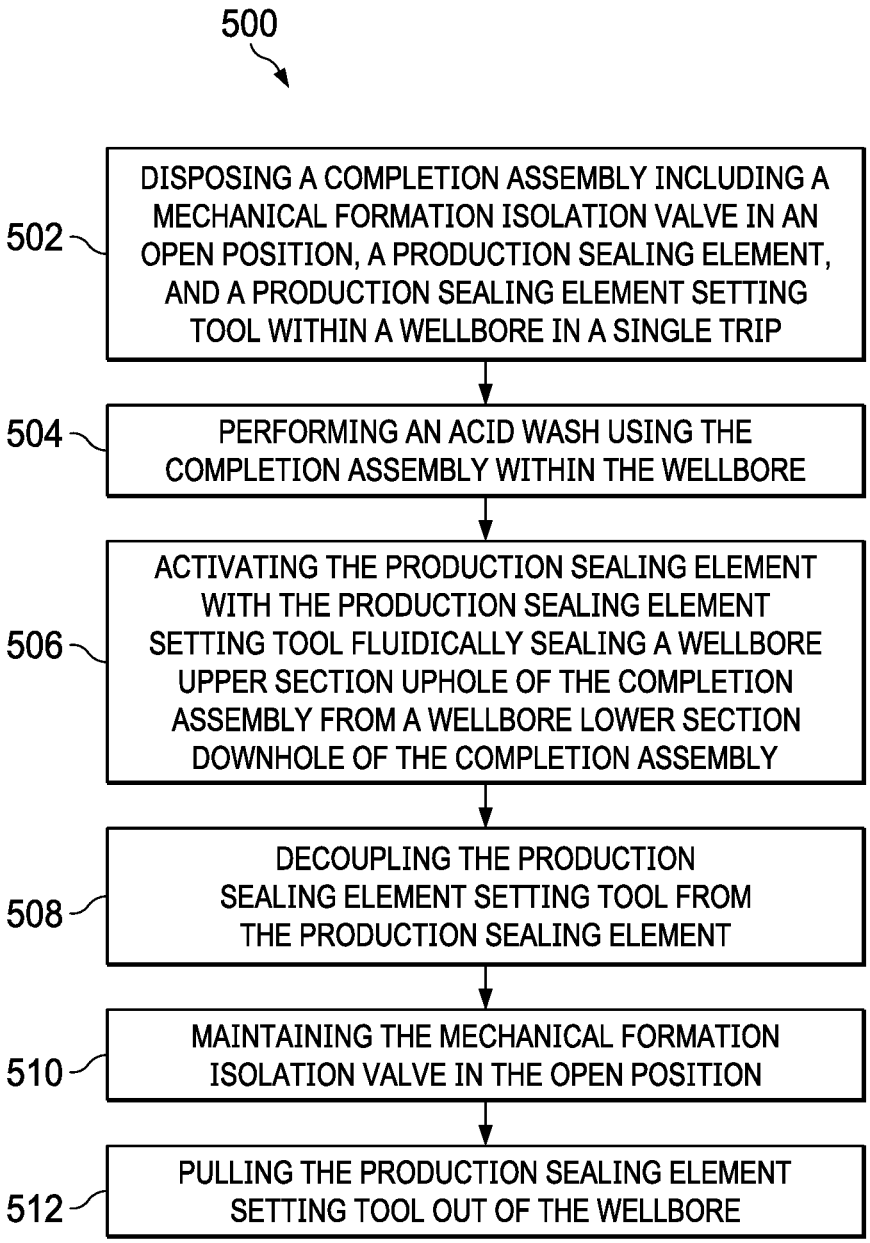
FIG. 3 is a flow chart of an example method of completing a wellbore using the lower completion assembly of FIG. 1.

Referring to FIG. 3, a method 500 for completing a lower section of a wellbore 400 in a single trip with the lower completion assembly 100 is shown. At 502, a completion assembly including a mechanical formation isolation valve in an open position, a production sealing element, and a production sealing element setting tool is disposed within a wellbore in a single trip (502). At 504, an acid wash is performed using the completion assembly within the wellbore (504). At 506, after performing the acid wash, the production sealing element is activated with the production sealing element setting tool fluidically sealing a wellbore upper section uphole of the completion assembly from a wellbore lower section downhole of the completion assembly (506). At 508, the production sealing element setting tool is decoupled from the production sealing element (508). At 510, the mechanical formation isolation valve is maintained in the open position (510). At 512, the production sealing element setting tool is pulled out of the wellbore (512).

Figure 4:
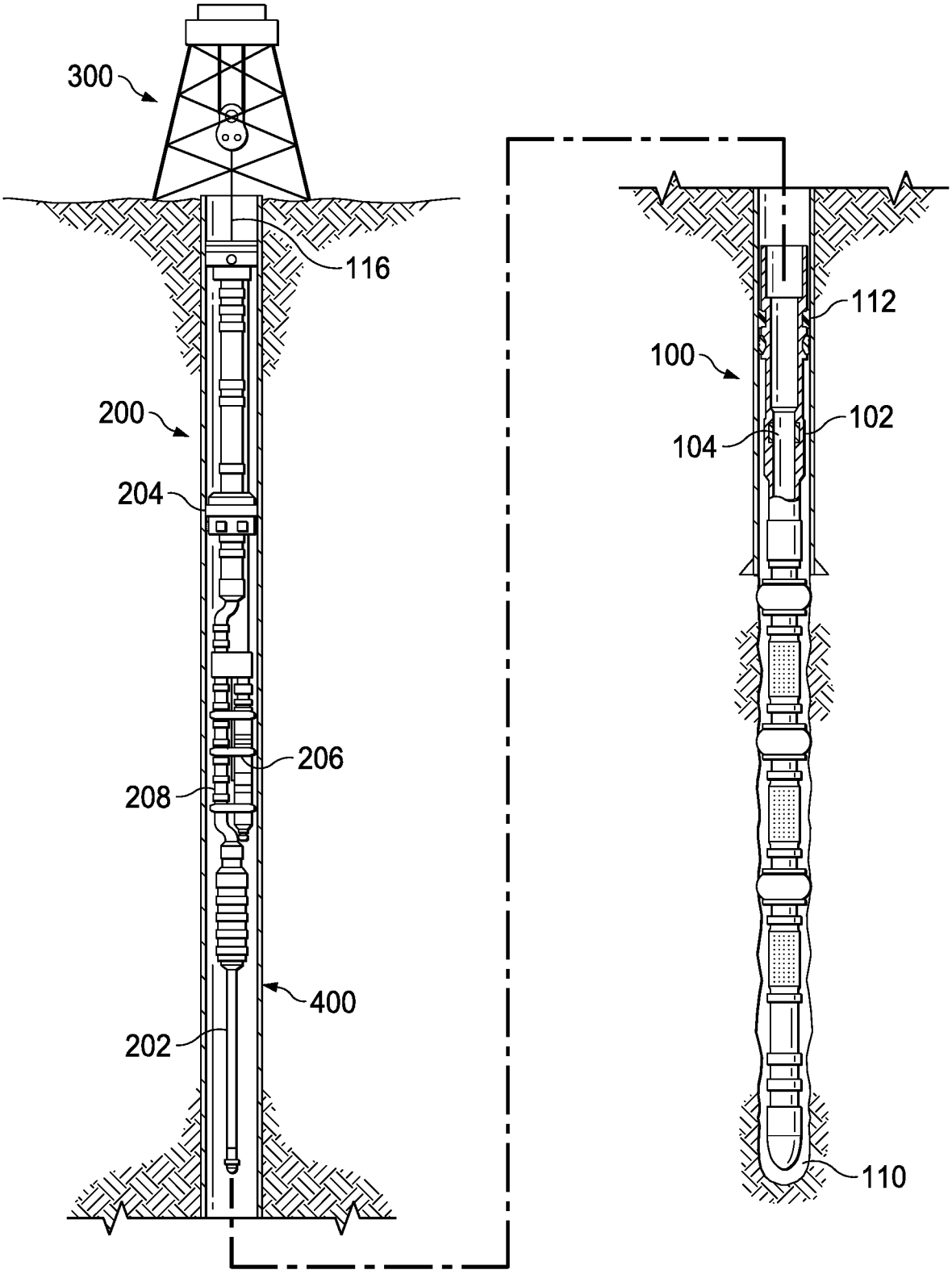
FIG. 4 is a schematic view of a second upper section completion assembly disposed in the upper section of the wellbore uphole from the first lower completion assembly of FIG. 1.

FIG. 4 shows a second upper completion assembly 200 disposed in the upper section of the wellbore 400 uphole from the first lower completion assembly 100. The second upper completion assembly 200 includes a shifting key tool 202 configured to shift the mechanical formation isolation valve between the open position 104 and a closed position 106 (shown in FIG. 5B). FIG. 4 shows the mechanical formation isolation valve 102 in the open position 104

In some implementations, the second upper completion assembly 200 can be assembled outside the wellbore 400. The second upper completion assembly 200 can contain additional equipment to complete the well. The second upper completion assembly 200 can contain upper completion packers 204, electric submersible pumps 206, bypass tubing 208, and tubing 116. Upper completion packers 204 are actuated to mechanically engage the wellbore 400 to isolate sections of the wellbore 400 from other adjacent sections of the wellbore 400 and to stabilize and support the second upper completion assembly 200 in the wellbore 400. Upper completion packers can be positioned throughout the second upper completion assembly 200. Electric submersible pumps 206 provide a motive force to lift oil, gas, and water from the wellbore 400 to the surface of the Earth. A bypass tubing 208 can be mechanically coupled around the electric submersible pump 206 to conduct various completion operations. The tubing 116 connects the various second upper completion components together. The tubing 116 also connects the second upper completion assembly 200 to the drilling rig 300.

FIGS. 5A and 5B are schematics of the upper completion assembly 200 shifting key tool 202 coupled to the mechanical formation isolation valve 102 of the lower completion assembly 100. FIG. 5A shows the mechanical formation isolation valve 102 in the open position 104. FIG. 5B shows shifting key tool 202 actuated causing the mechanical formation isolation valve 102 to be in the closed position 106.

Figure 6:
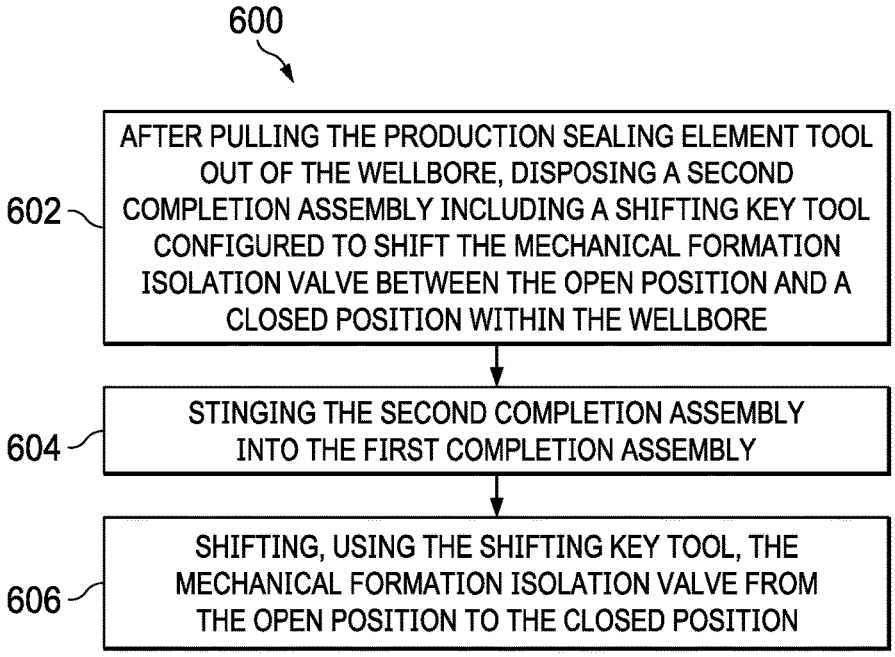
FIG. 6 is a flow chart of an example method of shifting the position of the mechanical formation isolation valve disposed in a lower section of a wellbore of FIG. 1.

Referring to FIG. 6, a method 600 for shifting the position of the mechanical formation isolation valve 102 disposed in a lower section of a wellbore 400 in a single trip with the lower completion assembly 100 is shown. At 602, after pulling the production sealing element tool out of the wellbore, disposing a second completion assembly including a shifting key tool configured to shift the mechanical formation isolation valve between the open position and a closed position is disposed within the wellbore (602). At 604, the second completion assembly is stung into the first completion assembly (604). At 606, the mechanical formation isolation valve is shifted using the shifting key from the open position to the closed position (606).

Figure 7:
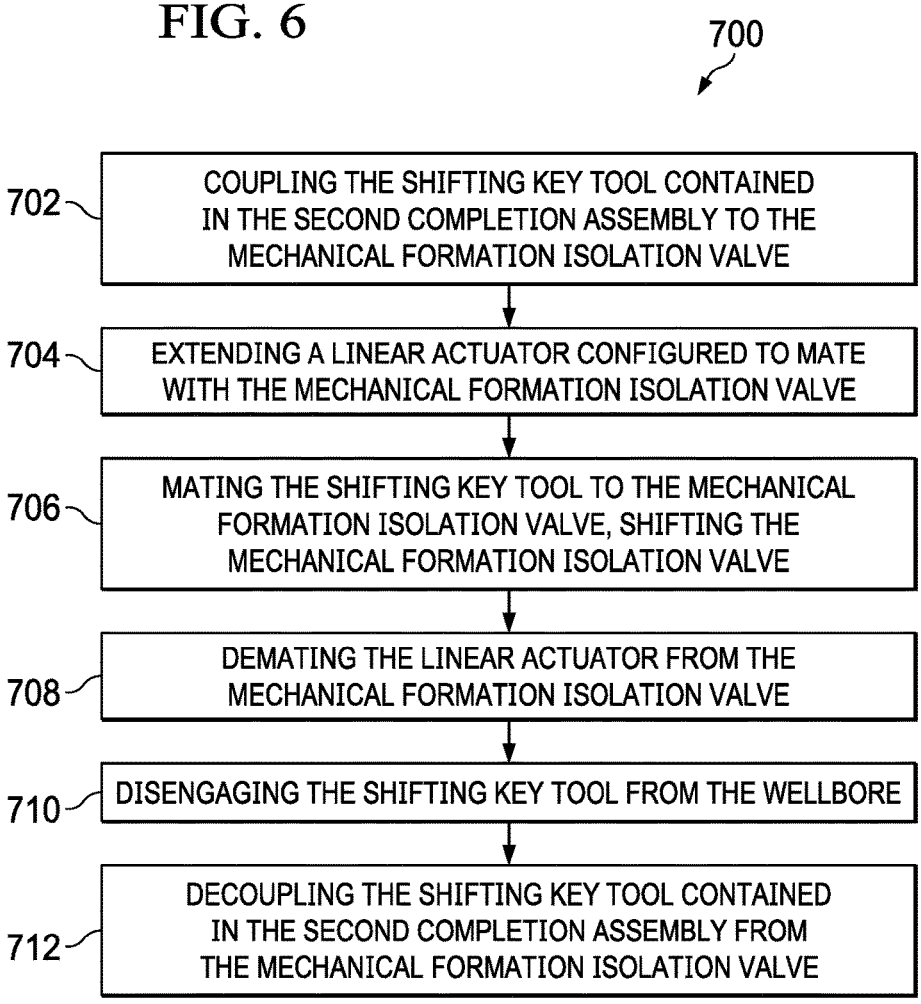
FIG. 7 is a flow chart of an example method for shifting the position of the mechanical formation isolation valve the open position to the closed position using an anchor and liner actuator shifting tool.

Referring to FIG. 7, a method 700 for shifting the position of the mechanical formation isolation valve 102 from the open position 104 to the closed position 106 disposed in a lower section of a wellbore 400 in a single trip with the lower completion assembly 100 using an anchor and liner, sealing element and MFIV shifting tool at the end of the running string. As the shifting tool is inside the mechanical formation isolation valve in this case, the MFIV is in open position. At 702, the mechanical formation isolation valve shifting tool contained in the second completion assembly is coupled to the mechanical formation isolation valve which is in open position while lowering the completion in wellbore (702). At 704, the linear actuator configured to mate with the mechanical formation isolation valve is extended (704). At 706, the mechanical formation isolation valve shifting key tool is mated to the mechanical formation isolation valve, shifting the mechanical formation isolation valve (706). At 708, the linear actuator is de-mated from the anchor and liner with the mechanical formation isolation valve (708). At 710, the shifting tool is disengaged from the wellbore (710). At 712, the shifting tool contained in the second completion assembly is decoupled from the mechanical formation isolation valve (712). The mechanical formation isolation valve is now in the closed position.

Figure 8:
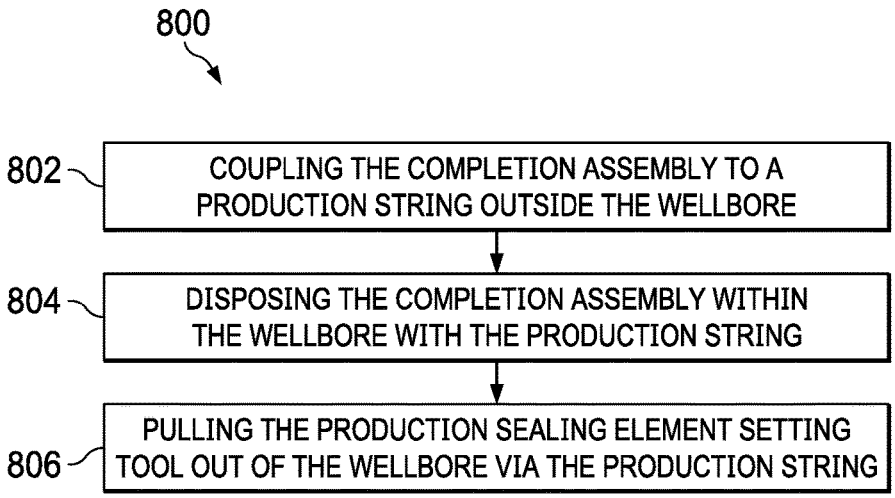
FIG. 8 is a flow chart of an example method for disposing the completion assembly of FIG. 1 with additional equipment within the wellbore in a single trip.

Referring to FIG. 8, a method 800 for disposing the completion assembly 200 with additional equipment within the wellbore 400 in the single trip with a production string is shown. At 802, the completion assembly is coupled to a production string outside the wellbore (802). At 804, the completion assembly within the wellbore is coupled with the production string (804). At 806, the production sealing element setting tool is pulled out of the wellbore via the production string (806).

In some implementations, the tubing 116 is a wash pipe. The wash pipe is connected to the sealing element setting tool 114. The wash pipe is used to perform the acid wash. The acid wash consist of disposing acidic chemicals in the wash pipe to flush the lower completion assembly 100 after installation in the wellbore 400.

Figure 9:
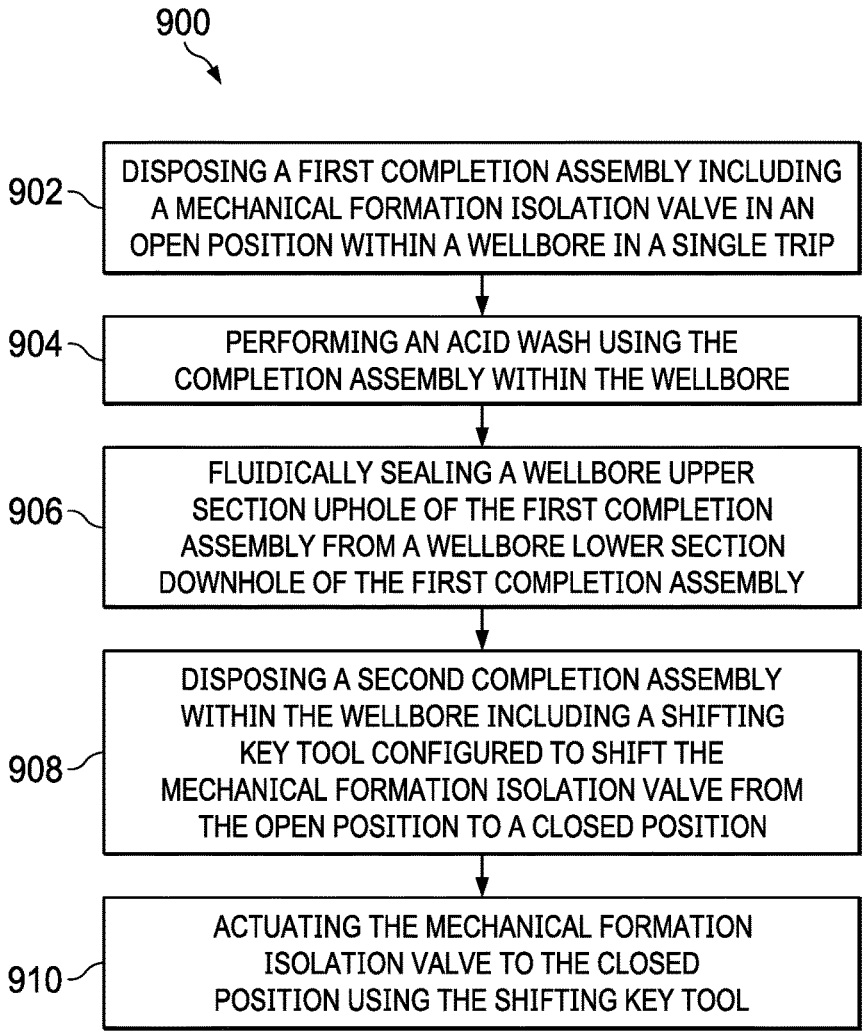
FIG. 9 is a flow chart of an example method for completing a wellbore lower section, conducting an acid wash in a wellbore, and completing a wellbore upper section.

FIG. 9 is a method 900 for completing a wellbore lower section, conducting an acid wash in a wellbore 400, and completing a wellbore upper section. At 902, a first completion assembly including a mechanical formation isolation valve in an open position is disposed within a wellbore in a single trip (902). At 904, an acid wash is performed using the completion assembly within the wellbore (904). At 906, after performing the acid wash, a wellbore upper section uphole of the first completion assembly is fluidically sealed from a wellbore lower section downhole of the first completion assembly using the first completion assembly (906). At 908, a second completion assembly is disposed within the wellbore after disposing the first completion assembly within the wellbore and performing the acid wash. The second completion assembly includes a shifting key tool configured to shift the mechanical formation isolation valve from the open position to a closed position (908). At 910, the mechanical formation isolation valve is actuated, by the shifting key tool, to the closed position (910).

In some implementations, the method 900 for completing a wellbore lower section, conducting an acid wash in a wellbore 400, and completing a wellbore upper section further includes coupling a first completion assembly to a production string outside a wellbore. The first completion assembly includes a screened inflow control device, a swell packer, a mechanical formation isolation valve in an open position, a production sealing element, and a production sealing element setting tool.

In some implementations, the method 900 for completing a wellbore lower section, conducting an acid wash in a wellbore 400, and completing a wellbore upper section further includes fluidically sealing a wellbore upper section uphole of the first completion assembly from a wellbore lower section downhole of the first completion assembly with the first completion assembly by activating the production sealing element with the production sealing element setting tool. Activating the production sealing element causes a production sealing element outer surface to mechanically engage the wellbore.

In some implementations, the method 900 for completing a wellbore lower section, conducting an acid wash in a wellbore 400, and completing a wellbore upper section further includes, after fluidically sealing the well, decoupling the production sealing element setting tool from the production sealing element. The method further incudes maintaining the mechanical formation isolation valve in the open position. The method further includes pulling the production sealing element setting tool and the production string out of the wellbore.

In some implementations, the method 900 for completing a wellbore lower section, conducting an acid wash in a wellbore 400, and completing a wellbore upper section further includes assembling a second completion assembly outside the wellbore. The second completion assembly includes a production tubing, an electric submersible pump packer, and an electric submersible pump. The method further includes disposing the second completion assembly within the wellbore. The method further includes coupling the second completion assembly to the first completion assembly. The method further includes actuating the mechanical formation isolation valve to the open position.

In some implementations, the method 900 for completing a wellbore lower section, conducting an acid wash in a wellbore 400, and completing a wellbore upper section further includes attaching a wash pipe to the first completion assembly. The method further includes disposing the first completion assembly within a wellbore in a single trip. The method further includes performing an acid wash using the completion assembly within the wellbore. The method further includes pulling the wash pipe, the production sealing element setting tool, and the production string out of the wellbore.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

The invention claimed is:

1. A method comprising:

disposing a completion assembly within a wellbore in a single trip, the completion assembly comprising a mechanical formation isolation valve in an open position, a production sealing element, and a production sealing element setting tool;

performing an acid wash using the completion assembly within the wellbore;

after performing the acid wash, activating the production sealing element with the production sealing element setting tool fluidically sealing a wellbore upper section uphole of the completion assembly from a wellbore lower section downhole of the completion assembly;

decoupling the production sealing element setting tool from the production sealing element;

maintaining the mechanical formation isolation valve in the open position; and pulling the production sealing element setting tool out of the wellbore.

2. The method of claim 1, wherein the completion assembly is a first completion assembly, wherein, after pulling the production sealing element tool out of the wellbore, the method further comprises:

disposing a second completion assembly within the wellbore, the second completion assembly comprising a shifting key tool configured to shift the mechanical formation isolation valve between the open position and a closed position;

stinging the second completion assembly into the first completion assembly; and shifting, using the shifting key tool, the mechanical formation isolation valve from the open position to the closed position.

3. The method of claim 2, wherein shifting, using the shifting key tool further comprising an anchor and a linear actuator, the mechanical formation isolation valve from the open position to the closed position comprises:

coupling the shifting key tool contained in the second completion assembly to the mechanical formation isolation valve;

anchoring the shifting key tool to the wellbore;

extending a linear actuator configured to mate with the mechanical formation isolation valve;

mating the shifting key tool to the mechanical formation isolation valve;

shifting the mechanical formation isolation valve with the linear actuator;

de-mating the linear actuator from the mechanical formation isolation valve;

disengaging the shifting key tool from the wellbore; and decoupling the shifting key tool contained in the second completion assembly from the mechanical formation isolation valve.

4. The method of claim 3, wherein shifting, using the shifting key tool further comprising a circular profile key, the mechanical formation isolation valve from the open position to the closed position comprises:

coupling the shifting key tool contained in the second completion assembly to the mechanical formation isolation valve;

anchoring the shifting key tool to the wellbore;

extending a linear actuator configured to mate with the mechanical formation isolation valve;

mating the shifting key tool to the mechanical formation isolation valve;

extending the circular profile key to latch the mechanical formation isolation valve;

shifting the mechanical formation isolation valve with the linear actuator and circular profile key;

contracting the circular profile key to de-latch the mechanical formation isolation valve;

de-mating the linear actuator from the mechanical formation isolation valve;

disengaging the shifting key tool from the wellbore; and decoupling the shifting key tool contained in the second completion assembly from the mechanical formation isolation valve.

5. The method of claim 1, wherein disposing the completion assembly within the wellbore in the single trip further comprises:

coupling the completion assembly to a production string outside the wellbore;

disposing the completion assembly within the wellbore with the production string; and pulling the production sealing element setting tool out of the wellbore via the production string.

6. The method of claim 1, wherein the completion assembly comprises a screened inflow control device and a swell packer, wherein the method further comprises disposing the screened inflow control device and the swell packer within the wellbore in the single trip.

7. The method of claim 1, wherein the completion assembly comprises a wash pipe, wherein the method further comprises:

disposing the wash pipe within the wellbore in the single trip; and pulling the wash pipe out of the wellbore when pulling the production sealing element setting tool out of the wellbore.

8. A method comprising:

disposing a completion assembly within a wellbore in a single trip, the completion assembly comprising a screened multi-tasking valve inflow control device, a mechanical formation isolation valve in an open position, a production sealing element, and a production sealing element setting tool;

performing an acid wash using the completion assembly within the wellbore;

after performing the acid wash, activating the production sealing element with the production sealing element setting tool, fluidically sealing a wellbore upper section uphole of the completion assembly from a wellbore lower section downhole of the completion assembly;

decoupling the production sealing element setting tool from the production sealing element;

maintaining the mechanical formation isolation valve in the open position; and pulling the production sealing element setting tool out of the wellbore.

9. The method of claim 8, wherein the completion assembly is a first completion assembly, wherein, after pulling the production sealing element tool out of the wellbore, the method further comprises:

disposing a second completion assembly within the wellbore, the second completion assembly comprising a shifting key tool configured to shift the mechanical formation isolation valve between the open position and a closed position;

stinging the second completion assembly into the first completion assembly; and shifting, using the shifting key tool, the mechanical formation isolation valve from the open position to the closed position.

10. The method of claim 8, wherein shifting, using the shifting key tool further comprising an anchor and a linear actuator, the mechanical formation isolation valve from the open position to the closed position comprises:

coupling the shifting key tool contained in the second completion assembly to the mechanical formation isolation valve;

anchoring the shifting key tool to the wellbore;

extending a linear actuator configured to mate with the mechanical formation isolation valve;

mating the shifting key tool to the mechanical formation isolation valve;

shifting the mechanical formation isolation valve with the linear actuator;

de-mating the linear actuator from the mechanical formation isolation valve;

disengaging the shifting key tool from the wellbore; and decoupling the shifting key tool contained in the second completion assembly from the mechanical formation isolation valve.

11. The method of claim 8, wherein shifting, using the shifting key tool further comprises a circular profile key, the mechanical formation isolation valve from the open position to the closed position comprises:

coupling the shifting key tool contained in the second completion assembly to the mechanical formation isolation valve;

anchoring the shifting key tool to the wellbore;

extending a linear actuator configured to mate with the mechanical formation isolation valve;

mating the shifting key tool to the mechanical formation isolation valve;

extending the circular profile key to latch the mechanical formation isolation valve;

shifting the mechanical formation isolation valve with the linear actuator and circular profile key;

contracting the circular profile key to de-latch the mechanical formation isolation valve;

de-mating the linear actuator from the mechanical formation isolation valve;

disengaging the shifting key tool from the wellbore; and decoupling the shifting key tool contained in the second completion assembly from the mechanical formation isolation valve.

12. The method of claim 8, wherein disposing the completion assembly within the wellbore in the single trip further comprises:

coupling the completion assembly to a production string outside the wellbore;

disposing the completion assembly with in the wellbore with the production string;

pulling the production sealing element setting tool out of the wellbore via the production string; and actuating the mechanical formation isolation valve to a closed position with the mechanical formation isolation valve shifting tool.

13. A method comprising:

disposing a first completion assembly within a wellbore in a single trip, the first completion assembly comprising a mechanical formation isolation valve in an open position;

performing an acid wash using the first completion assembly within the wellbore;

after performing the acid wash, fluidically sealing, by the first completion assembly, a wellbore upper section uphole of the first completion assembly from a wellbore lower section downhole of the first completion assembly;

disposing a second completion assembly within the wellbore after disposing the first completion assembly within the wellbore, the second completion assembly comprising a shifting key tool configured to shift the mechanical formation isolation valve from the open position to a closed position; and actuating, by the shifting key tool the mechanical formation isolation valve to the closed position.

14. The method of claim 13, further comprising:

coupling a first completion assembly to a production string outside a wellbore, the first completion assembly comprising a screened inflow control device, a swell packer, a mechanical formation isolation valve in an open position, a production sealing element, and a production sealing element setting tool.

15. The method of claim 13, wherein fluidically sealing, by the first completion assembly, a wellbore upper section uphole of the first completion assembly from a wellbore lower section downhole of the first completion assembly further comprises activating the production sealing element with the production sealing element setting tool, wherein activating the production sealing element causes a production sealing element outer surface to mechanically engage the wellbore.

16. The method of claim 13, further comprising:

after fluidically sealing the wellbore, decoupling the production sealing element setting tool from the production sealing element;

maintaining the mechanical formation isolation valve in the open position; and pulling the production sealing element setting tool and the production string out of the wellbore.

17. The method of claim 13, further comprising:

assembling a second completion assembly outside the wellbore, the second completion assembly comprising a production tubing, an electric submersible pump packer, and an electric submersible pump;

disposing the second completion assembly within the wellbore;

coupling the second completion assembly to the first completion assembly; and actuating the mechanical formation isolation valve to the open position.

18. The method of claim 13, wherein performing the acid wash further comprises:

attaching a wash pipe to the first completion assembly;

disposing the first completion assembly within a wellbore in a single trip;

performing an acid wash using the completion assembly within the wellbore; and pulling the wash pipe, the production sealing element setting tool, and the production string out of the wellbore.

* * * * *